US005719014A

United States Patent [19]

Merkel et al.

[11] Patent Number: 5,719,014

[45] Date of Patent: Feb. 17, 1998

[54] COLOR NEGATIVE FILMS CONTAINING YELLOW METHINE DYES FOR FILTRATION AND DENSITY CORRECTION

[75] Inventors: Paul Barrett Merkel, Victor; Melvin Michael Kestner, Hilton; James Anthony Friday, Rochester, all of N.Y.

[73] Assignee: Eastman Kodak Company, Rochester, N.Y.

[21] Appl. No.: 584,770

[22] Filed: Jan. 11, 1996

Related U.S. Application Data

[60] Provisional application No. 60/010,332, Oct. 31, 1995, abandoned.

[51] Int. Cl.[6] ..... G03C 1/46

[52] U.S. Cl. ..... 430/504; 430/507; 430/510; 430/517; 430/522; 430/559

[58] Field of Search ..... 430/504, 507, 430/510, 517, 522, 559

[56] References Cited

U.S. PATENT DOCUMENTS

| | | | |
|---|---|---|---|
| 4,316,013 | 2/1982 | Hunt | 542/445 |
| 4,764,455 | 8/1988 | Arakawa et al. | 430/533 |
| 4,840,884 | 6/1989 | Mooberry et al. | 430/557 |
| 5,079,134 | 1/1992 | Toya | 430/522 |
| 5,098,818 | 3/1992 | Ito et al. | 430/522 |
| 5,106,942 | 4/1992 | Krutaki et al. | 528/272 |
| 5,213,956 | 5/1993 | Diehl et al. | 430/522 |
| 5,260,179 | 11/1993 | Diehl et al. | 430/517 |
| 5,354,650 | 10/1994 | Southby et al. | 430/955 |
| 5,380,634 | 1/1995 | Kiekens et al. | 430/517 |
| 5,447,819 | 9/1995 | Mooberry et al. | 430/955 |
| 5,455,140 | 10/1995 | Texter et al. | 430/546 |
| 5,455,141 | 10/1995 | Owaczarczyk et al. | 430/359 |
| 5,457,004 | 10/1995 | Mooberry et al. | 430/359 |
| 5,470,688 | 11/1995 | Texter et al. | 430/559 |

FOREIGN PATENT DOCUMENTS

| | | |
|---|---|---|
| 4-40429 | 2/1992 | Japan . |
| 92/21064 | 11/1992 | WIPO . |

*Primary Examiner*—Geraldine Letscher
*Attorney, Agent, or Firm*—Arthur E. Kluegel

[57] ABSTRACT

The invention provides a multilayer color negative photographic film comprising a support, at least one light-sensitive silver halide layer sensitive to each of the blue, green and red regions of the visible spectrum and a yellow or orange-yellow methine dye of structure I,

I wherein:

$R_1$ is hydrogen or an alkyl group;

$R_2$ is an alkyl group or an aryl group;

$R_3$ is hydrogen, a halogen atom (such as chlorine or fluorine), an alkyl group, an alkoxy group or an aryloxy group;

$R_4$ is hydrogen or an alkyl group;

$R_5$ is hydrogen or an alkyl group;

$R_6$ is hydrogen or an alkyl group;

X is oxygen or sulfur;

each $R_7$ is independently a substituent selected from the group consisting halogen atoms, and alkyl, aryl, alkoxy, aryloxy, carbonamido, sulfonamido, carbamoyl, alkoxycarbonyl, aryloxycarbonyl, acyloxy, acyl, sulfamoyl, sulfonyl, sulfoxyl, sulfonyloxy, alkylthio, arylthio, and cyano groups;

n is 0, 1, 2 or 3; and $R_1$ and $R_2$ or $R_2$ and $R_3$ may join to form a ring.

22 Claims, No Drawings

COLOR NEGATIVE FILMS CONTAINING YELLOW METHINE DYES FOR FILTRATION AND DENSITY CORRECTION

CROSS-REFERENCE TO RELATED APPLICATION

This application is a continuation of Provisional application Ser. No. 60/010,332 filed Oct. 31, 1995, now abandoned.

FIELD OF THE INVENTION

This invention relates to color negative photographic materials or elements comprising yellow methine dyes for filtration and density correction.

approximately 480 nm. When two color negative films that have different dye sets with different density ratios at 440 nm vs 480 nm are printed together using a printer such as the KODAK 3510 Printer, the resulting prints will have different color balances, and the two color negative films are said to be printer incompatible. An orange dye with additional absorption at 480 nm relative to 440 nm is sometimes added to the film with the lower absorption at 480 nm to render the two negative films more printer compatible. The orange dye C1, below, has been used for this purpose. However, this dye does not have good stability, and when negatives containing it are printed following long-term storage color imbalances may be observed.

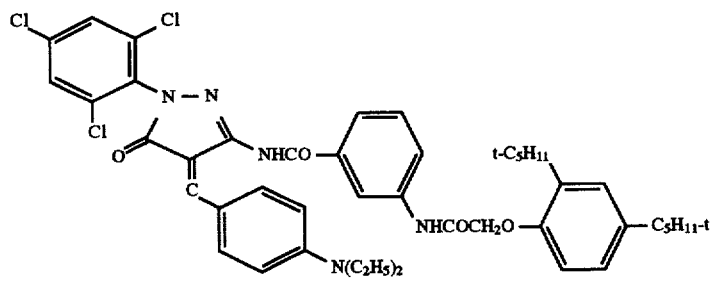

C1

BACKGROUND OF THE INVENTION

Modern color negative films usually contain dyes coated in one or more layers for a variety of purposes. In addition to being utilized for spectral sensitization, dyes may be used for filtration of specific wavelengths of exposing light (either as intergrain absorbers or in separate layers containing no silver halide), for antihalation and to adjust the background density ($D_{min}$) of color negative films for printing purposes. Dyes that are used to adjust $D_{min}$ of color negative films to produce prints of proper color balance may be referred to as density correction dyes. However, such dyes may also be used for filtration and/or antihalation purposes in addition to being used to adjust color balance.

Yellow and orange dyes that have been used in color negative films for antihalation and for $D_{min}$ adjustment have suffered from a number of deficiencies including poor dispersibility, improper hue and instability on long term storage or on storage at elevated temperatures. Losses in blue density due to dye instability can result in improper color balance when prints are made from negatives that have been stored for appreciable times either before or after development. Some yellow dyes that are stable by themselves become unstable when coated in the same layer as other components, such as reducing agents that serve as scavengers for oxidized developer. Thus, there is a need for yellow dyes that retain stability in the presence of other chemicals typically incorporated into color negative films.

Orange dyes have been added to some color negative films to improve the color balance of color prints made on certain printers. Many color printers scan the average red, green and blue densities of a color negative and use these readings to automatically adjust exposures for proper density and color balance. The peak spectral sensitivities of printer scanners do not always match the peak sensitivities of a color paper. For example, the peak blue sensitivity of KODAK 3510 Printers occurs at approximately 440 nm, whereas the peak blue sensitivity of many color papers is at One way to attack the instability problem associated with a dye such as C1 is to identify more stable orange dyes. Another approach is to identify stable yellow dyes or orange-yellow dyes with greater absorption in the region of 480 nm and to use such a dye to replace both the yellow and orange density correction/antihalation dyes used conventionally in combination. It is further desired that such yellow or yellow-orange dyes be readily dispersed and inexpensive to manufacture.

The AGFA MSP Printer scanner has considerable blue sensitivity in the region of 400–440 nm, where most color papers have negligible sensitivity. Thus, two films having different density ratios at 480 nm relative to 400–440 nm my yield prints of different color balance when printed using the AGFA MSP printer. The use of density correction dyes of the proper hue can minimize or eliminate such printing problems.

Usually yellow filter dyes that are used between the blue and green-sensitive records of color negative films are designed to bleach or to wash out of the films on processing. If yellow dyes having the proper spectra are selected, it is possible to use permanent yellow filter dyes that also function as density correction dyes, thereby reducing the amount of dye coated, coating thickness and film cost.

International Patent Application WO 92/21064 A1 (EP 540,729 A1) of Mooberry et al discloses photographic elements comprising blocked filter dyes that are designed to unblock and wash out on processing. Among the many blocked dyes disclosed is one blocked cyano benzoxazolyl arylidene dye (16), similar to the yellow methine dyes of this invention. Unlike the yellow methine dyes of the present invention, which are designed to be permanent, the blocked dyes of WO 92/21064 A1 are removed on processing. The blocked dye disclosed in WO 92/21064 A1 has a carboxyl substituent which is outside the scope of the substituents of the permanent methine dyes of our invention. Furthermore, WO 92/21064 A1 does not disclose use as density correction dyes or as filter dyes.

U.S. Pat. No. 4,840,884 of Mooberry and others discloses blocked cyano benzoxazolyl arylidene type methine dyes (Example 4) similar to the yellow methine dyes of our invention. However, the arylidene nitrogen atom of these dyes is substituted with a group that is outside the scope of our substituents ($R_1$ or alternatively $R_2$, below). Furthermore, these blocked dyes are not designed to be used in a filter layer or in an antihalation layer as preferred in our invention.

Japanese Kokai JP04-040429 discloses methine dyes similar to the yellow methine dyes of our invention in nonlinear optical recording materials. This disclosure does not pertain to photographic materials or to use of such dyes for filtration or density correction.

U.S. Pat. No. 5,106,942 (WO 91/07915) of Krutak et al discloses cyano benxoxazolyl and cyano benzothiazolyl arylidene type methine dyes attached to polymers, but offers no teaching of the use of such dyes in photographic elements or for filtration or density correction.

U.S. Pat. No. 4,316,013(GB 2,077,282) of Hunt discloses cyano benzoxazolyl and cyano benzothiazolyl arylidene type methine dyes for dyeing of synthetic fibers. However, this reference does not teach the use of such dyes in photographic elements or for filtration or density correction, nor does it or the other art teach the specific structural and spectral requirements for proper filtration or for density correction.

SUMMARY OF THE INVENTION

The invention provides a multilayer color negative photographic film comprising a support, at least one light-sensitive silver halide layer sensitive to each of the blue, green and red regions of the visible spectrum and a yellow or orange-yellow methine dye of structure I,

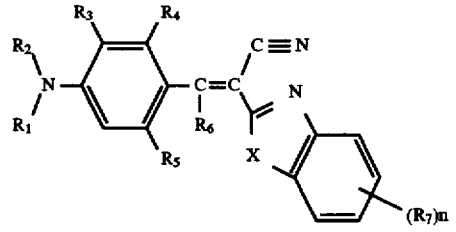

I wherein:

$R_1$ is hydrogen or an alkyl group;

$R_2$ is an alkyl group or an aryl group;

$R_3$ is hydrogen, a halogen atom (such as chlorine or fluorine), an alkyl group, an alkoxy group or an aryloxy group;

$R_4$ is hydrogen or an alkyl group;

$R_5$ is hydrogen or an alkyl group;

$R_6$ is hydrogen or an alkyl group;

X is oxygen or sulfur;

each $R_7$ is independently a substituent selected from the group consisting halogen atoms, and alkyl, aryl, alkoxy, aryloxy, carbonamido, sulfonamido, carbamoyl, alkoxycarbonyl, aryloxycarbonyl, acyloxy, acyl, sulfamoyl, sulfonyl, sulfoxyl, sulfonyloxy, alkylthio, arylthio, and cyano groups;

n is 0, 1, 2 or 3; and $R_1$ and $R_2$ or $R_2$ and $R_3$ may join to form a ring.

When the dye of the invention is employed, some or all the conventional yellow dye(s) or Carey-Lea silver used for filtration of blue light may be eliminated from the photographic element.

DETAILED DESCRIPTION OF THE INVENTION

This invention relates to color negative photographic materials or elements comprising one or more yellow methine filter dyes or density correction dyes having the generic structure shown in the Summary of the Invention. The yellow methine dyes of this invention are preferably coated in a filter layer between blue and green sensitive layers or in an antihalation layer. When used in a filter layer the yellow methine dyes of this invention may replace some or all of either the bleachable yellow dye(s) or the Carey-Lea silver normally used for filtration. Thus, the invention provides color negative films comprising density correction dyes that produce prints of proper color balance. Also, it provides negatives that after long term storage continue to provide prints of the proper color balance due to use of density correction dyes having improved thermal stability. Further, the invention provides color negative films comprising yellow methine dyes that are used both for filtration of blue light during exposure and for density correction to provide proper color balance in printing. Moreover, the invention can provide color negative films comprising yellow methine dyes that are used both for density correction and antihalation. Additionally, the invention can provide thinner color negative films by using a single yellow dye for both filtration of blue light and density correction and by the use of high covering power density correction dyes of the proper hue. Still further, the invention provides color negative films in which a single density correction dye replaces both yellow and orange density correction or antihalation dyes; provides improved blue versus green exposure separation by enhanced filtration of blue light from the green record(s) of color negative films; and provides color negative films comprising filter dyes or density correction dyes that are easily and inexpensively manufactured and readily dispersible.

In one embodiment of this invention $R_1$ is hydrogen. In another embodiment of this invention $R_2$ is an alkyl group. In another embodiment of this invention n is 0, 1 or 2. In a preferred embodiment of this invention $R_4$ is hydrogen. In another embodiment of this invention X is oxygen. In another embodiment of this invention $R_5$ is an alkyl group. In a further embodiment of this invention $R_3$ is an alkoxy group. In another embodiment of this invention $R_6$ is hydrogen. In a suitable embodiment of this invention $R_1$ is hydrogen, $R_2$ is alkyl, $R_3$ is hydrogen or alkyl, $R_4$ is hydrogen, $R_5$ is alkyl, $R_6$ is hydrogen, X is oxygen, n is 0 or 1, and $R_7$ is an alkyl group, a sulfonamido group or a halogen atom, such as chlorine, in the para position relative to the oxygen of the benzofuran ring. In another embodiment of this invention $R_1$ and $R_2$ are alkyl groups, $R_3$, $R_4$ and $R_6$ are hydrogen, $R_5$ is an alkyl group, n is 0 or 1 and $R_7$ is an alky group, a sulfonamido group or a halogen in the para position relative to X, which is oxygen.

The color negative films of this invention may be color print films used for making color prints on color photographic paper or they may be motion picture color negative films.

Useful absorption maxima for the yellow methine dyes of this invention depend upon the spectral band shapes and the primary intended use (filtration or density correction) but are in the range of 435–475 nm as coated in the photographic materials of this invention. Preferably the spectral absorption maxima of the coated yellow methine dyes of this invention are in the range of 440–470 nm. The optimum spectra and laydowns of the dyes of this invention depend upon whether they are used for filtration or density correction and, in the latter case, upon the degree of density correction required. Useful coated levels of the yellow methine dyes of this invention also depend upon molecular weight and extinction coefficient, but typically range from 0.005 to 0.15 g/sq m, with levels of 0.010 to 0.10 g/sq m being preferred.

The alkyl substituents comprising $R_1$ through $R_7$ may unbranched, branched or cyclic and may be unsubstituted or substituted. The alkoxy groups comprising $R_3$ or $R_7$ may be unbranched or branched and may be substituted or unsubstituted. The aryl groups comprising $R_2$ or $R_7$ and the aryloxy groups comprising $R_3$ or $R_7$ may be unsubstituted or substituted. The carbonamido, sulfonamido, carbamoyl, acyloxy, acyl, alkoxycarbonyl, aryloxycarbonyl, sulfamoyl, sulfonyl, sulfoxyl, sulfonyloxy, alkylthio and arylthio groups comprising $R_7$ may also be further substituted. Any substituent may be chosen for the alkyl, aryl, alkoxy, aryloxy and $R_7$ groups that does not adversely affect the performance of the yellow methine density correction dyes of this invention. Suitable substituents include halogen atoms, such as chlorine, alkenyl groups, alkynyl groups, aryl groups, hydroxy groups, alkoxy groups, aryloxy groups, acyl groups, acyloxy groups, alkoxycarbonyl groups, aryloxycarbonyl groups, carbonamido groups (including alkyl-, aryl-, alkoxy-, aryloxy- and alkylamino-carbonamido groups), carbamoyl groups, carbamoyloxy groups, sulfonamido groups, sulfamoyl groups, alkylthio groups, arylthio groups, sulfoxyl groups, sulfonyl groups, sulfonyloxy groups, alkoxysulfonyl groups, aryloxysulfonyl groups, trifluoromethyl groups, cyano groups, imido groups and heterocyclic groups, such as 2-furyl, 3-furyl, 2-thienyl, 1-pyrrolyl, 2-pyrrolyl, 1-imidazolyl and N-succinimidyl groups. The aryl groups comprising $R_2$ and the groups comprising $R_7$ may also be substituted with one or more unbranched, branched or cyclic alkyl groups.

It is also desirable that the yellow methine dyes of this invention have low water solubility and remain in the layer(s) in which they are coated during coating, storage and processing. To help ensure this, the total number of carbon atoms in $R_1$ through $R_7$ taken together is at least 8, add preferably at least 10. In addition, to minimize diffusion and washout, the yellow methine dyes of this invention do not contain charged groups, such as quaternary ammonium groups, or easily ionizable carboxyl or sulfonate groups.

The yellow methine dyes of this invention are incorporated in the photographic materials of this invention by first dispersing a dye-containing oil phase in an aqueous phase containing a binder, such as gelatin, and one or more surfactants. The dye-containing dispersion is then coated in the appropriate layer of a multilayer film on a suitable support. The oil phase usually consists of the dye dissolved in one or more high-boiling solvents. This is typically added to an aqueous solution of gelatin and surfactant, which is followed by milling or homogenization of the mixture to disperse the oil phase in the aqueous phase as small particles. Removable (by washing or evaporation) auxiliary solvents such as ethyl acetate or cyclohexanone may also be used in the preparation of such dispersions to facilitate dissolution of the dye in the oil phase. However, some yellow methine dyes of this invention do not require the use of a removable auxiliary solvent for dispersion preparation. The yellow methine dyes of this invention may also be dispersed as solid particle dispersions via ball milling.

Hues of the yellow methine dyes of this invention can be shifted to optimize the spectral properties by choice of high-boiling solvent. High-boiling solvents useful for the practice of this invention include aryl phosphates (e.g. tricresyl phosphate), alkyl phosphates (e.g. trioctyl phosphate), mixed aryl alkyl phosphates (e.g. diphenyl 2-ethylhexyl phosphate), aryl, alkyl or mixed aryl-alkyl phosphonates, phosphine oxides (e.g. trioctylphosphine oxide), esters of aromatic acids (e.g. dibutyl phthalate), esters of aliphatic acids (e.g. dibutyl sebacate), alcohols (e.g. 2-hexyl-1-decanol), phenols (e.g. p-dodecylphenol), carbonamides (e.g. N,N-dibutyldodecanamide or N-butylacetanalide), sulfoxides (e.g. bis(2-ethylhexyl) sulfoxide), sulfonamides N,N-dibutyl-p-toluenesulfonamide) or hydrocarbons (e.g. dodecylbenzene). Additional high-boiling solvents and auxiliary solvents are noted in Research Disclosure, December 1989, Item 308119, p 993. Useful dye:high-boiling solvent weight ratios range from about 1:0.1 to 1:10, with 1:0.2 to 1:5.0 being preferred. The yellow dyes of this invention may also be dispersed without the use of a permanent high-boiling solvent.

The yellow methine dyes of this invention may be coated in the color negative photographic materials of this invention either alone in one or more layers or together with other dyes or addenda in the same layers or layer. The yellow dyes of this invention can be coated in any layer on either side of the support. In one preferred embodiment of this invention the yellow density correction dyes are coated in an antihalation layer under (i.e. furthest from the direction of exposure) the light-sensitive silver halide layers. The antihalation layer is often adjacent to the transparent support. The yellow dyes of this invention may also be coated between the green-sensitive and red-sensitive layers of the color negative films of this invention. In another preferred embodiment, the yellow dyes of this invention are coated in a filtration layer under the blue-sensitive layer(s) and over the green sensitive layer(s) of the color negative film. This reduces unwanted blue exposure of the green-sensitive layers and can allow removal of some or all of normally used filtration materials, such as bleachable yellow dyes or Carey-Lea silver. The yellow dyes of this invention may also be coated above the blue sensitive layer(s) of the color negative films for adjustment of blue speed. The yellow dyes of this invention may also be coated in an emulsion-containing layer such as the least-sensitive magenta dye forming layer.

In particularly useful embodiments of this invention the yellow methine dyes of this invention are coated in either a filtration layer between the blue and green-sensitive layers or in an antilahation layer, usually adjacent to the support.

Examples of nondiffusible yellow methine dyes of this invention include, but are not limited to, the following (D1–D35):

D1
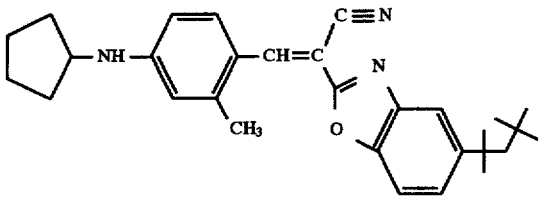
D2
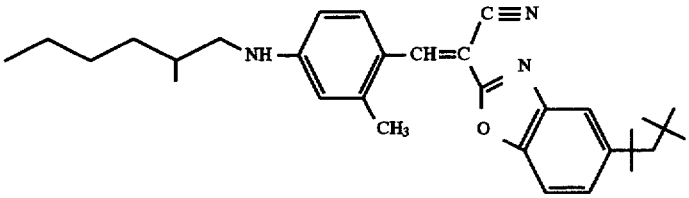
D3
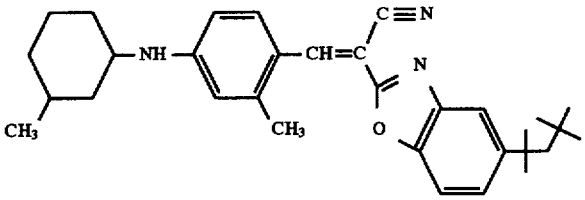
D4
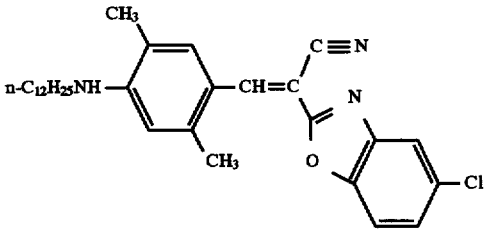
D5
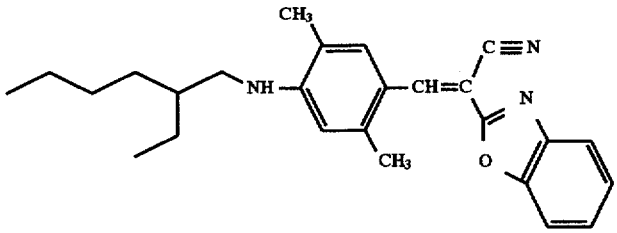
D6
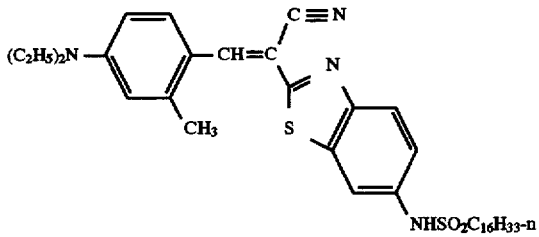
D7
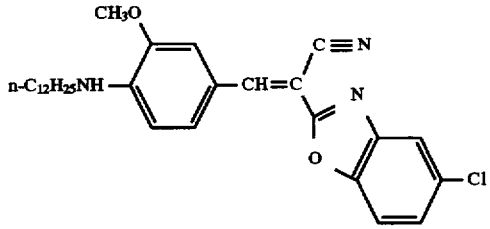

-continued
D8
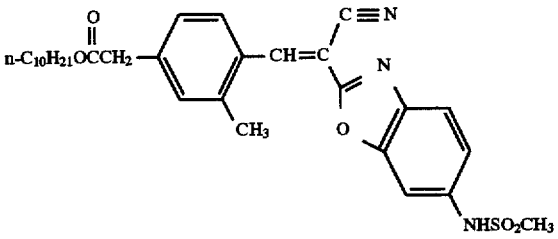
D9
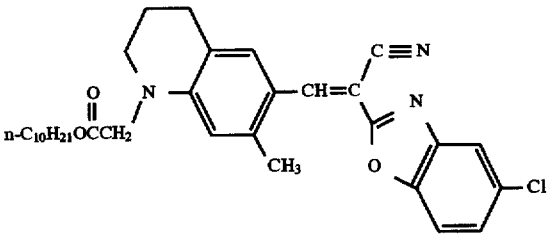
10
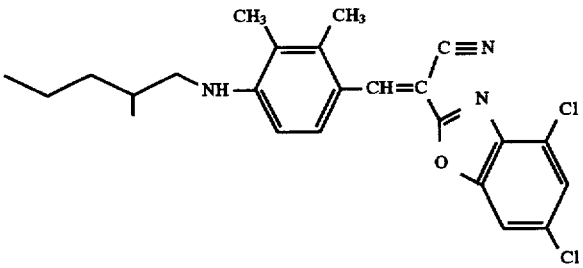
D11
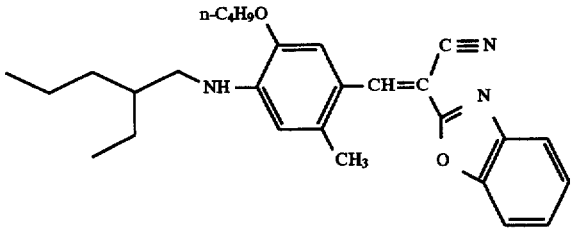
D12
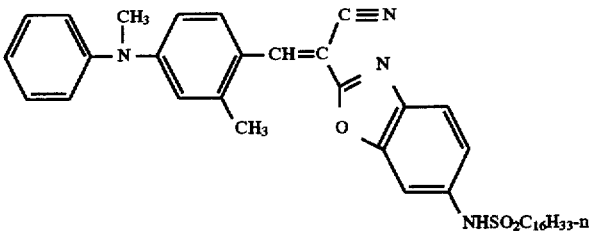
D13
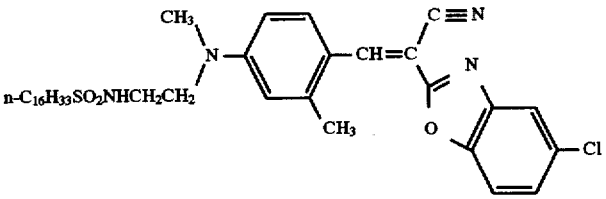

-continued
D14
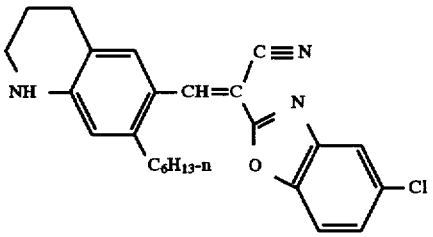
D15
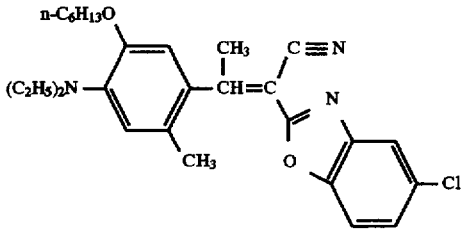
D16
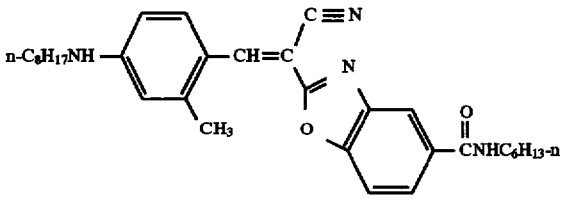
D17
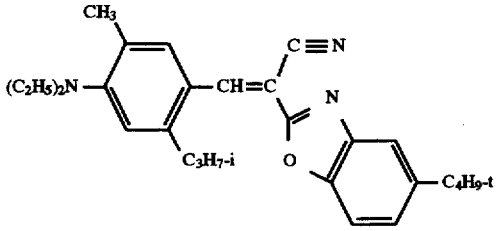
D18
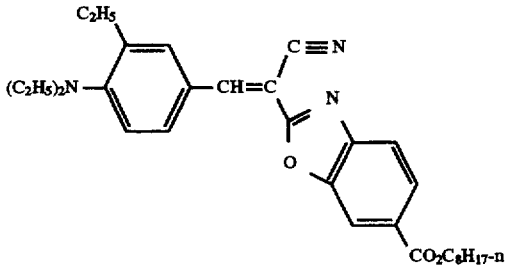
D19
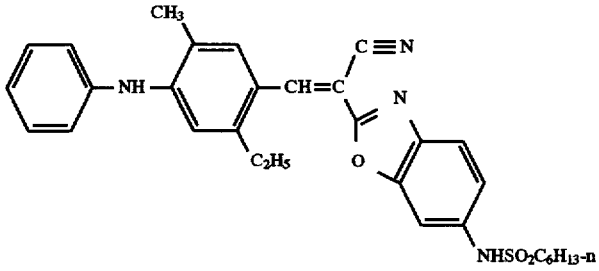

-continued
D20
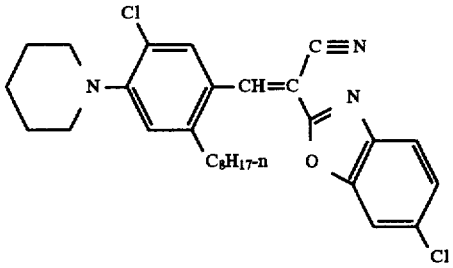
D21
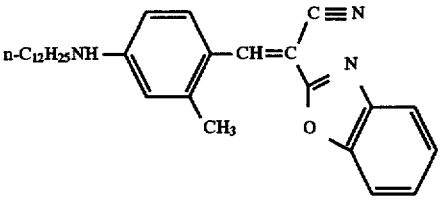
D22
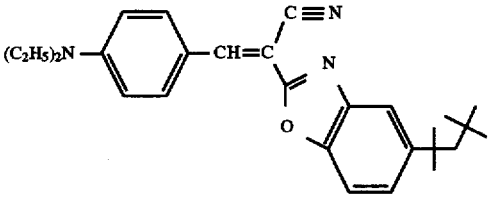
D23
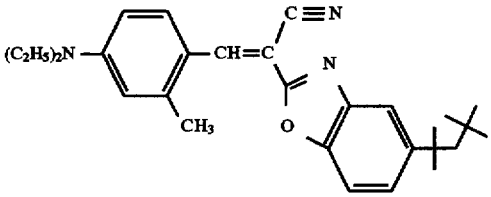
D24
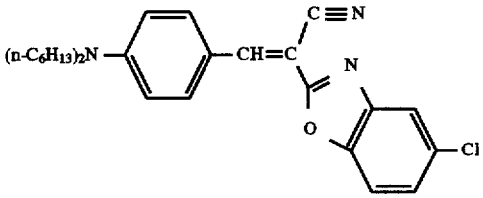
D25
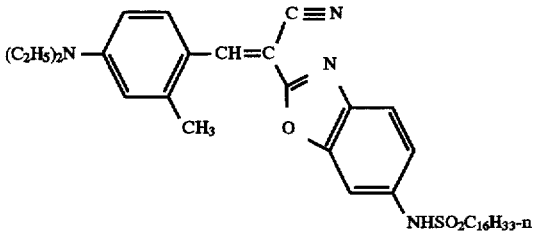
D26
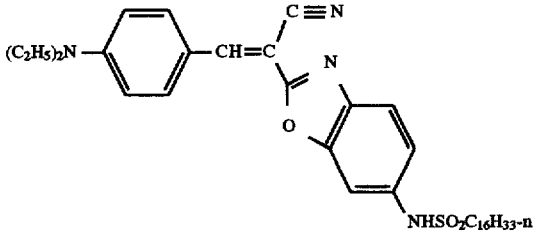

-continued
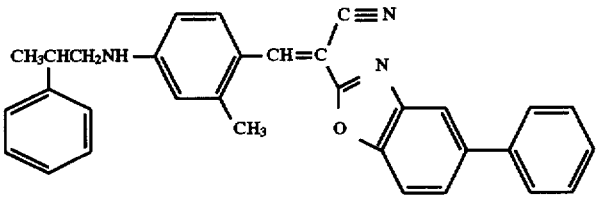
D27
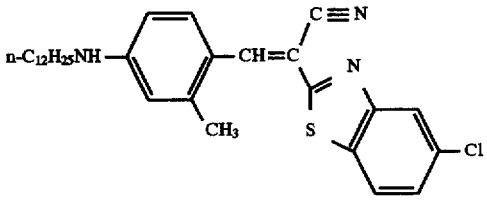
D28
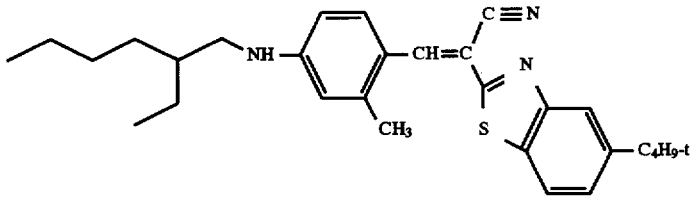
D29
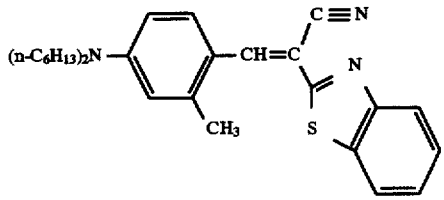
D30
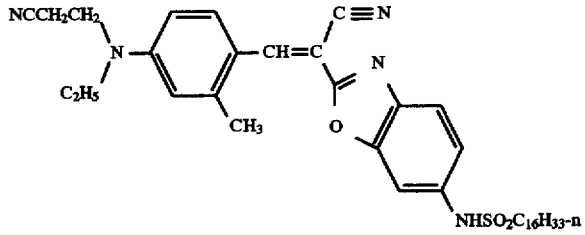
D31
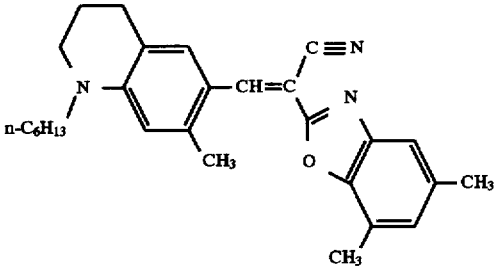
D32
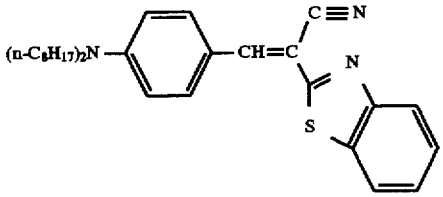
D33

-continued

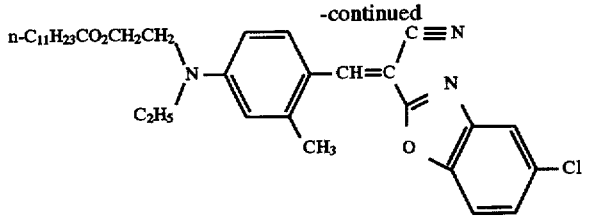

D34

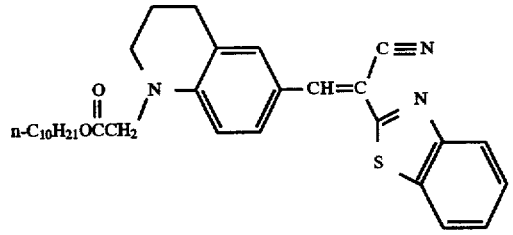

D35

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy)propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)hexanamido, alpha-(4-hydroxy-3-t-butylphenoxy)tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a silver halide emulsion and the emulsion coated as a layer on a support to form part of a photographic element.

Multicolor elements contain image dye-forming units sensitive to each of the three primary regions of the spectrum. Each unit can comprise multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1994, Item 36544, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

The silver halide emulsion containing elements employed in this invention are negative-working as indicated by the type of processing instructions (i.e. color negative) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Scan facilitating is described in Section XIV. Supports, exposure, development systems, and processing methods and agents are described in Sections XV to XX. Certain desirable photographic elements and processing steps are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Ser. Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized and color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine LiteratureUbersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: U.K. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. Nos. 4,301,235; 4,853,319 and 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. No. Nos. 2,983,608; 4,070,191; and 4,273,861; German Applications DE 2,706,117 and DE 2,643,965; U.K. Patent 1,530,272; and Japanese Application 58-113935. The masking couplers may be shifted or blocked, if desired.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. Nos. 4,163,669; 4,865,956; and 4,923,784, may be useful. Also contemplated is use of the compositions in association with nucleating agents, development accelerators or their precursors (UK Patent 2,097,140; U.K. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. Nos. 4,420,556; and 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science* and *Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIR) couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or Group is selected from the following formulas:

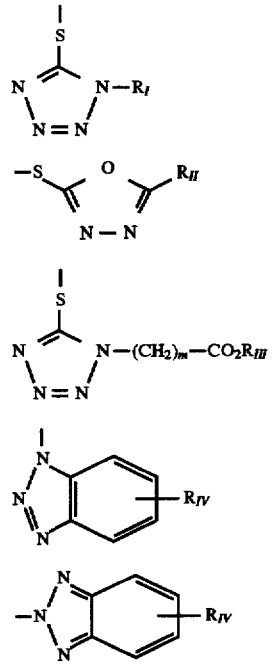

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. Nos. 4,409,323; 4,421,845; Japanese Applications 57-188035; 58-98728; 58-209736; 58-209738) groups utilizing ester hydrolysis (German Patent Application (OLS) No. 2,626,315; groups utilizing the cleavage of imino ketals (U.S. Pat. No. 4,546,073); groups that function as a coupler or reducing agent after the coupler reaction (U.S. Pat. Nos. 4,438,193; 4,618,571) and groups that combine the features describe above. It is typical that the timing group or moiety is of one of the formulas:

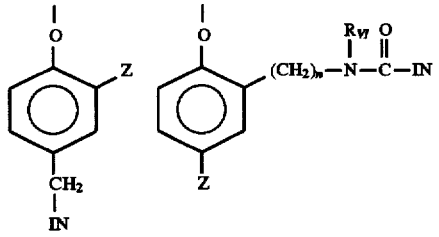

wherein IN is the inhibitor moiety, Z is selected from the group consisting of nitro, cyano, alkylsulfonyl; sulfamoyl ($—SO_2NR_2$); and sulfonamido ($—NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

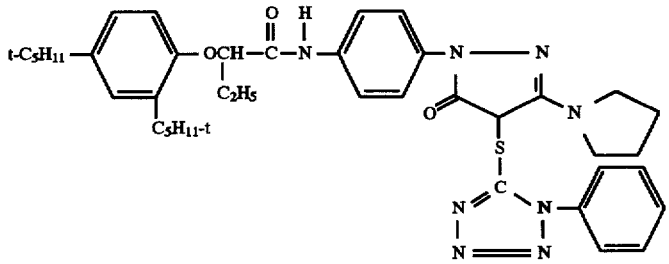

D2

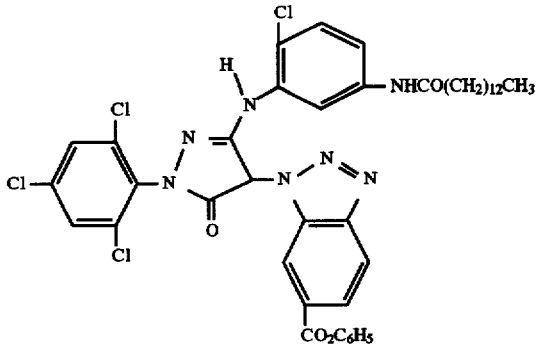

D3

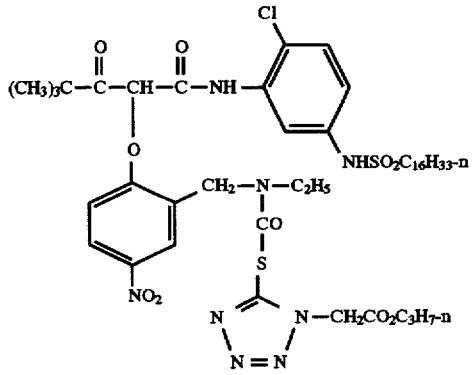

D4

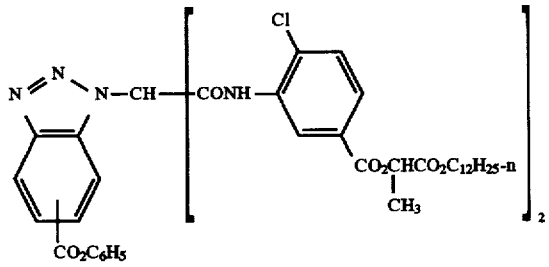

D5

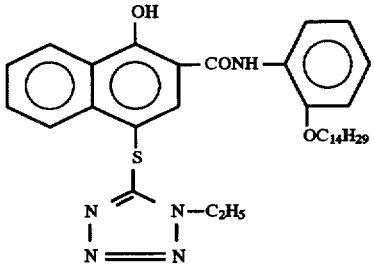

-continued
D6
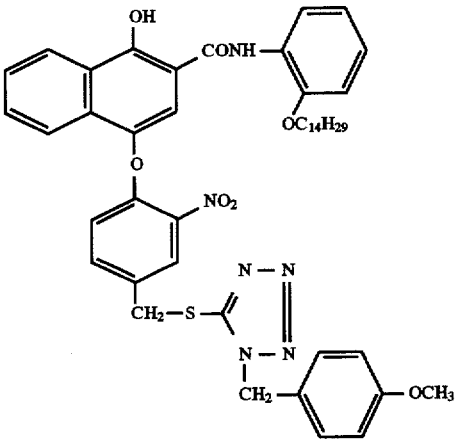
D7
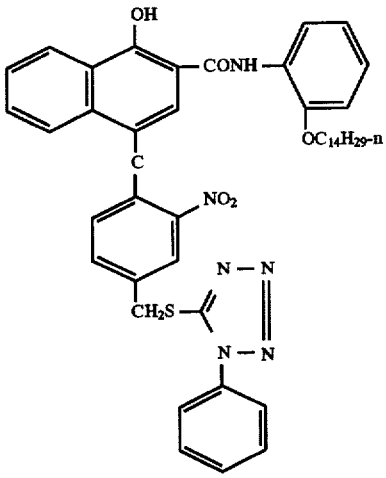
D8
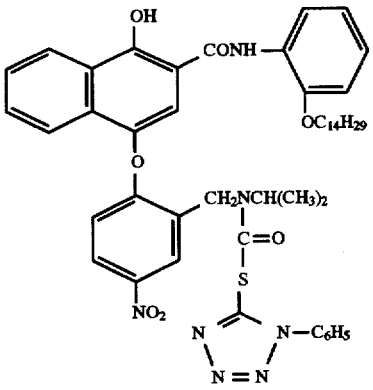
D9
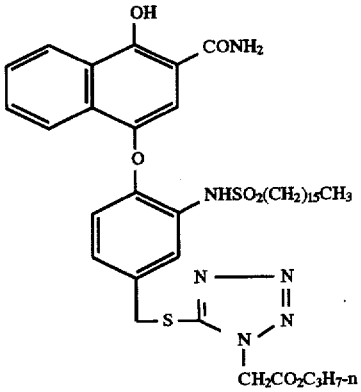
D10
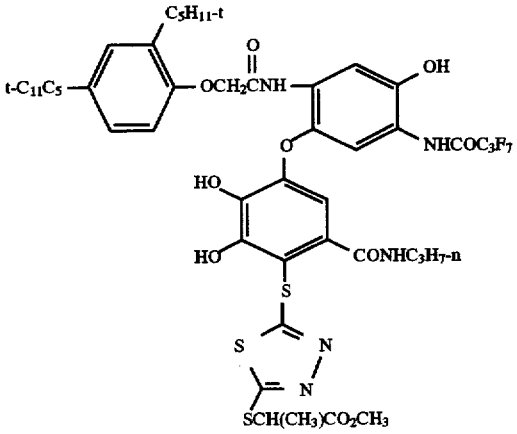
D-11
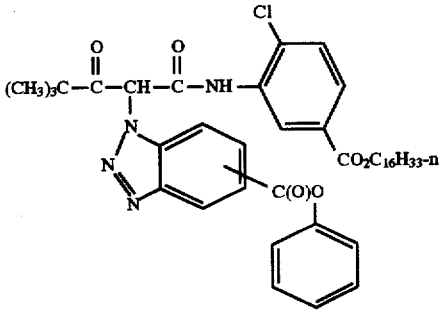
D-12
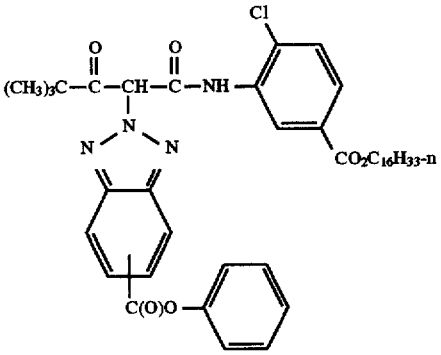

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.06 micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known Kodak C-41 color process as described in The British Journal of Photography Annual of 1988, pages 191–198. Such negative working emulsions are typically sold with instructions to process using a color negative method such as the mentioned C-41 process.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl) aniline sesquisulfate hydrate, 4-amino-3-methyl-N-ethyl-N-(2-hydroxyethyl)aniline sulfate, 4-amino-3-(2-methanesulfonamido-ethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the various copending applications as well as patents and other publications cited in this specification are incorporated herein by reference.

The usefulness and advantages of the color negative materials of this invention comprising the yellow density correction or filter dyes of this invention are illustrated by the following Examples, which show the desirable filtration properties of the yellow dyes of this invention and the improved printer compatibility of the color negative films of this invention.

EXAMPLE 1

Spectral Comparisons of Density Correction Dyes

To illustrate the spectral differences of conventional density correction dyes such as C2 and the yellow methine density correction dyes of this invention, single-layer dye coatings were prepared and evaluated. All of the density correction dyes were dispersed and coated together with the high-boiling solvent tritolyl phosphate (S-1) (mixed isomers) at a 1:2 dye to S-1 weight ratio. For example, a dispersion and coating of D1 was prepared as follows. An oil phase consisting of 13.0 g of D1, 26.0 g of S-1 and 39.0 g of ethyl acetate was added to an aqueous phase consisting of 39.0 g of gelatin 3.9 g of a surfactant (sodium tri-isopropylnaphthalene sulfonate) in 529 ml of water. The oil phase was dispersed in the aqueous phase in the form of small particles by passing the mixture through a colloid mill in a manner known in the art. The ethyl acetate auxiliary solvent was removed by evaporation resulting in a dispersion that contained 2.1% by weight of dye D1. A sample of the dispersion of D1 was coated on a transparent cellulose acetate support together with additional gelatin, a spreading agent and formaldehyde hardener at a D1 laydown of about 0.065 g/sq m to provide a transmission optical density at the absorption maximum of about 0.7. Dispersions of the other density correction dyes were prepared similarly, and these dyes were similarly coated at levels sufficient to provide optical densities of approximately 0.7.

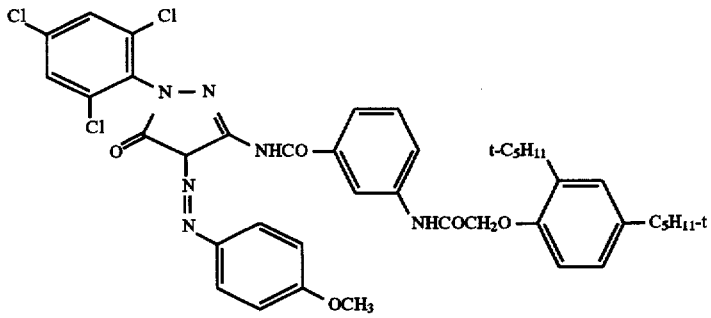

C2

After hardening, the coatings were washed for 5 min at 25 C. and dried. The dye absorption spectra were measured on a Perkin Elmer Lambda 2S spectrophotometer. Table I provides spectral data for the coating of comparative dye C2 with S-1 as well as for dyes D1, D2, D23, D25 and D26 of this invention coated with S-1. Absorption maxima in nm are listed in Table I as well as density ratios at 480:440 nm and at 510:480 nm. It is evident from the data in Table I that the dyes of this invention have higher 480:440 nm density ratios than dye C2. Coating the proper levels of dyes D1, D2, D23, D25 or D26 of this invention in place of a dye like C2 can render films with dye sets that absorb less strongly at 480 nm relative to 440 nm more compatibly to films with more bathochromic dye sets.

TABLE I

| Dye | Absorption Maximum (nm) | D 480 nm / D 440 nm | D 510 nm / D 480 nm |
|---|---|---|---|
| C2 | 438 | 0.77 | 0.50 |
| D1 | 457 | 1.02 | 0.34 |
| D2 | 456 | 0.99 | 0.35 |
| D23 | 460 | 1.08 | 0.35 |
| D25 | 465 | 1.20 | 0.51 |
| D26 | 466 | 1.20 | 0.46 |

It is also desirable that the yellow dyes of this invention not have strong absorption at wavelengths longer than about 510 nm, particularly if they are coated above the green and red sensitive layers to filter unwanted blue light. The low 510:480 nm density ratios for preferred density correction dyes of this invention permit their use for filtration of blue light in some instances.

An additional advantage of the yellow methine dyes of this invention is their relatively high covering power, which allows relatively low levels to be coated. This can reduce film cost and provide thinner films. For example, the covering power of comparative dye C2 in the coating composition of this example is only about 2.8 sq m/g, whereas the covering power values of dyes D1, D2 and D3 of this invention are about 10, 9 and 10 sq m/g, respectively, as coated in this example. This means that only about ⅓ as much D1, D2 or D3 need be coated to achieve the same density as C2.

Another advantage of the yellow methine dyes of this invention is their excellent thermal stability on storage. For example, example dye D1 (coated with S-1 at 1:2) undergoes less than 2% density loss after storage for one week at 70 C./50% RH, whereas dye C1 noted earlier looses 50% of its original density (coated with S-1 at 1:2) after storage for one week at 70 C./50% RH. The yellow methine density correction dyes of this invention also show improved stability over dye C2 and analogs when coated in the same layer as reducing agents such as 2,5-di-t-octyl hydroquinoine.

EXAMPLE 2

Printing Characteristics of a Color Negative Film of this Invention Comprising Yellow Methine Density Correction Dye D1 of this Invention The multilayer film structure utilized for this example is shown schematically in Table II. Structures of components not provided previously are given immediately following Table II. Component laydowns are provided in units of g/sq m unless otherwise indicated. Gelatin was used as a binder in the various layers of the multilayer film. Film A contains comparative density correction dye C2 coated in the antihalation layer (layer 14) at 0.103 g/sq m. Film B of this invention contains 0.028 g/sq m of density correction dye D23 of this invention in the antihalation layer. These films as well as commercially available 200 speed color negative film were given neutral exposures and processed using KODAK FLEXICOLOR C-41 processing chemistry.

The neutral steps of various density were then printed onto color paper using an AGFA MSP automatic printer that was adjusted to provide optimum color balance for prints made from the 200 speed negatives. The red, green and blue Status A densities of the prints were measured and the densities of the prints made from films A and B of Table II were compared to those of the check prints made from the 200 speed negatives. The Status A density differences are given in Table III for negatives that were overexposed by three stops. The density differences are much lower for prints made from film B of this invention. The reduction in the blue density difference for film B is significant and results in prints that are much less yellow in overexposure regions relative to the 200 speed prints than are prints made from the comparative film A using dye C2.

TABLE II

| MULTILAYER FILM STRUCTURE | |
|---|---|
| 1 Overcoat Layer: | Matte Beads<br>Gelatin (0.89) |
| 2 UV Protective Layer: | UV Absorber UV-1 (0.111) & S-4 (0.111)<br>UV Absorber UV-2 (0.111) & S-4 (0.111)<br>Silver Bromide Lippmann Emulsion (0.215 Ag)<br>Gelatin (0.70) |
| 3 Fast Yellow Layer: | Y-1 (0.150) & S-1 (0.075)<br>IR-1 (0.032) & S-1 (0.016)<br>B-1 (0.0054) BARC & S-3 (0.0070)<br>Blue Sensitive Silver Iodobromide Emulsion (0.430 Ag),<br>4.5 mole % Iodide Tabular-Grain (2.3 × 0.13 μm)<br>Gelatin (0.753) |
| 4 Slow Yellow Layer: | Y-1 (0.915) & S-1 (0.457)<br>IR-1 (0.032) & S-1 (0.016)<br>B-1 (0.0065) & S-3 (0.0084)<br>Blue Sensitive Silver Iodobromide Emulsion (0.178 Ag),<br>4.5 mole % Iodide Tabular-Grain (1.4 × 0.13 μm)<br>Blue Sensitive Silver Iodobromide Emulsion (0.118 Ag),<br>1.5 mole % Iodide Tabular-Grain (0.85 × 0.13 μm)<br>Blue Sensitive Silver Iodobromide Emulsion (0.178 Ag)<br>1.3 mole % Iodide Tabular-Grain (0.54 × 0.09 μm)<br>Gelatin (1.668)<br>Bis(vinylsulfonyl)methane Hardener at 2.1% by weight of total Gelatin |
| 5 Yellow Filter Layer: | R-1 (0.075) & S-2 (0.121) & ST-2 (0.010)<br>Gelatin (0.861)<br>C2 (0.097) & YD-2 Filter Dye (0.108) |
| 6 Fast Magenta Layer: | M-1 (0.059) & S-1 (0.053) & ST-1 (0.006)<br>MM-1 (0.027) & S-1 (0.054)<br>IR-2 (0.016) & S-2 (0.032)<br>Green Sensitive Silver Iodobromide Emulsion (0.699 Ag),<br>4.5 mole % Iodide Tabular-Grain (0.98 × 0.11 μm)<br>Gelatin (1.22) |
| 7 Mid Magenta Layer: | M-1 (0.129) & S-1 (0.116) & ST-1 (0.013)<br>MM-1 (0.032) & S-1 (0.064)<br>IR-2 (0.022) & S-2 (0.044)<br>Green Sensitive Silver Iodobromide Emulsion (0.646 Ag), 4.5 mole % Iodide Tabular-Grain (0.61 × 0.12 μm)<br>Gelatin (1.41) |
| 8 Slow Magenta Layer: | M-1 (0.172) & S-1 (0.155) & ST-1 (0.017)<br>MM-1 (0.038) & S-1 (0.076)<br>Green Sensitive Silver Iodobromide Emulsion (0.377 Ag),<br>3.3 mole % Iodide Cubic (0.275 μm)<br>Green Sensitive Silver Iodobromide Emulsion (0.108 Ag),<br>1.3 mole % Iodide Tabular-Grain (0.54 × 0.09 μm)<br>Gelatin (1.18) |
| 9 Interlayer: | R-1 (0.075) Interlayer Scavenger & S-6 (0.113)<br>Gelatin (0.86) |
| 10 Fast Cyan Layer: | CC-1 (0.161) & S-2 (0.161)<br>CM-1 (0.032)<br>IR-3 (0.038) & S-5 (0.076)<br>IR-4 (0.038) & S-2 (0.076)<br>Red Sensitive Silver Iodobromide Emulsion (0.968 Ag),<br>4.5 mole % Iodide Tabular-Grain (1.10 × 0.11 μm)<br>Gelatin (1.45) |
| 11 Mid Cyan Layer: | CC-1 (0.183) & S-2 (0.183)<br>CM-1 (0.011)<br>B-1 (0.027) & S-3 (0.035)<br>IR-3 (0.054) & S-5 (0.108)<br>Red Sensitive Silver Iodobromide Emulsion (0.215 Ag),<br>4.5 mole % Iodide Tabular-Grain (0.98 × 0.11 μm)<br>Red Sensitive Silver Iodobromide Emulsion (0.861 Ag),<br>3.3 mole % Iodide Cubic (0.49 μm)<br>Gelatin (1.35) |
| 12 Slow Cyan Layer: | CC-1 (0.387) & S-2 (0.387)<br>IR-4 (0.011) & S-2 (0.022)<br>B-1 (0.075) & S-3 (0.098)<br>Red Sensitive Silver Iodobromide Emulsion (0.387 Ag),<br>3.3 mole % Iodide Cubic (0.32 μm)<br>Gelatin (1.64) |
| 13 Interlayer: | R-1 (0.075) & S-6 (0.113)<br>Gelatin (0.86) |
| 14 Antihalation Layer: | Grey Silver (0.15 Ag), CD-1(0.0161),<br>MD-1 (0.043)<br>UV-1 (0.0753), S-4 (0.0753), S-1<br>Gelatin (1.61)<br>& A C2 (0.103)<br>or B D23 (0.028) and S-1 (0.056) |
| Cellulose Triacetate Support | |

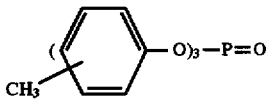

mixed isomers

S-1

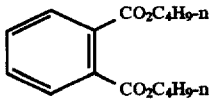

S-2

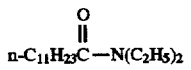

S-3

-continued
S-4
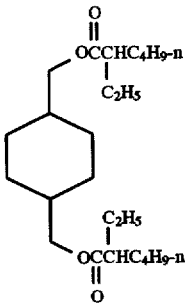
S-5
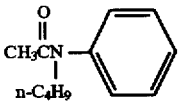
S-6
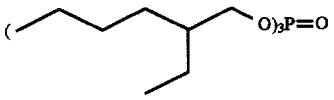
UV-1
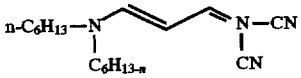
UV-2
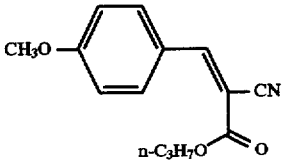
Y-1
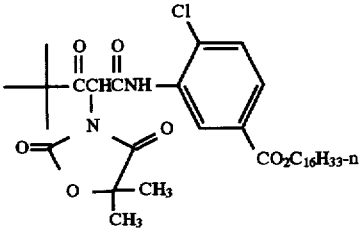
IR-1
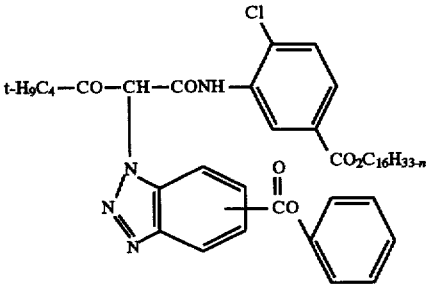
YD-2
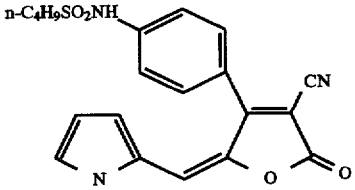

-continued
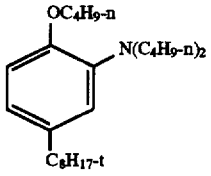
ST-1
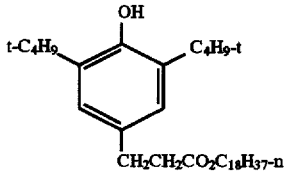
ST-2
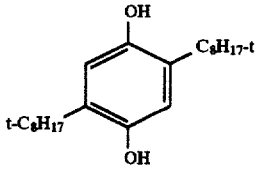
R-1
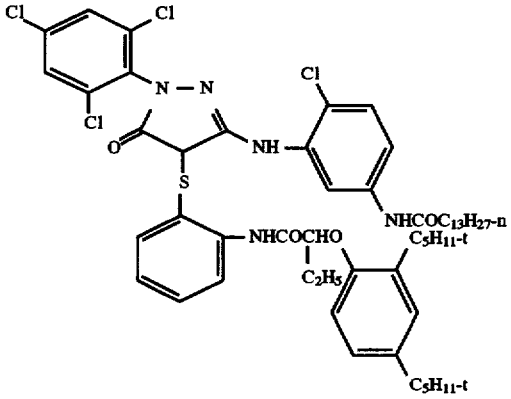
M-1
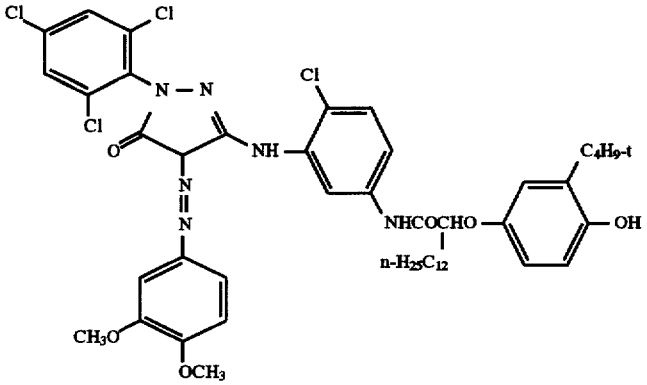
MM-1

-continued
CC-1
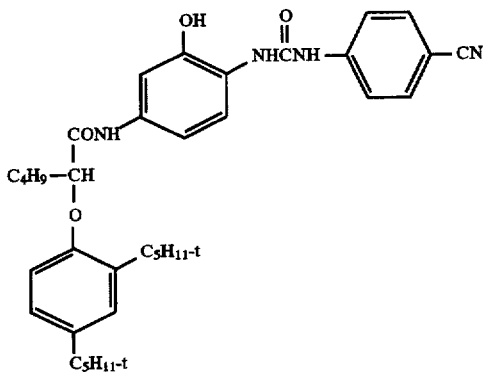
CM-1
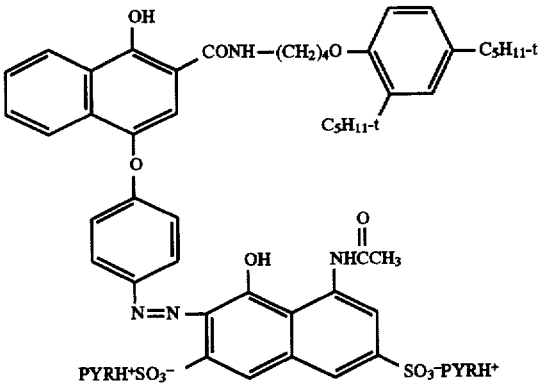
IR-2
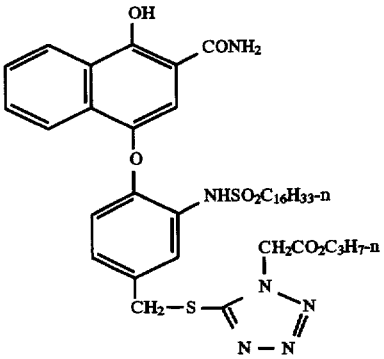
IR-3
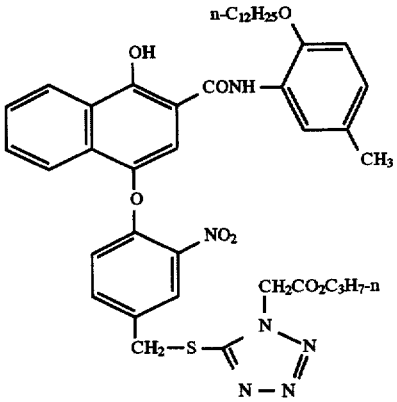

-continued

IR-4

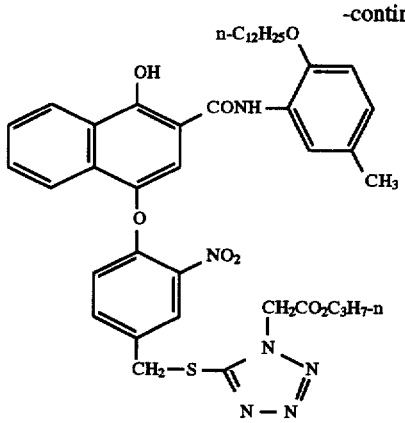

B-1

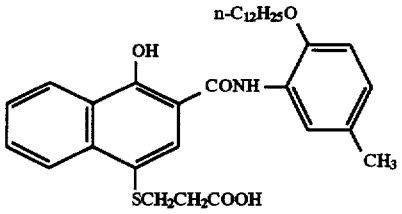

CD-1

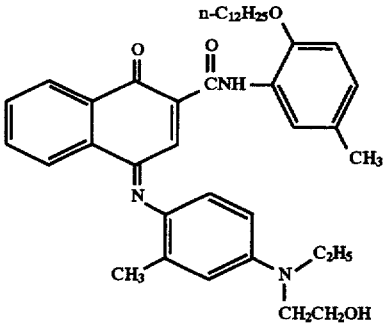

MD-1

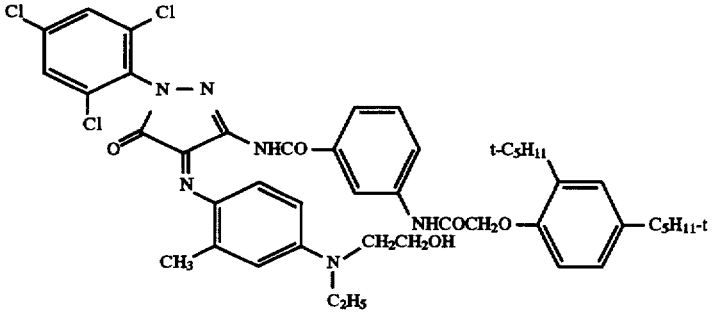

TABLE III

| Status A Density Differences vs Prints from Conventional 200 speed film at 3 Stops Overexposure | | | |
|---|---|---|---|
| Multilayer Film | Red | Green | Blue |
| A (Comparative) | −0.04 | 0.00 | 0.07 |
| B (Comparative) | −0.03 | 0.00 | 0.02 |

EXAMPLE 3

Use of the Yellow Methine Dyes of This Invention in the Yellow Filter Layer of a Color Negative Film for Filtration of Blue Light as Well as for Dmin Adjustment For this example, dyes that are normally used for filtration of blue light and for Dmin adjustment in the yellow filter layer of a high speed color negative film are replaced with a yellow methine dye of this invention. The multilayer film structure is shown in Table IV. Component laydowns are given in units of g/sq m in parentheses. Structures not provided previously are shown following Table IV. Film C utilizes 0.065 g/sq m of the bleachable yellow filter dye YD-2 in the yellow filter layer plus 0.172 g/sq m of the permanent dye C2 in the antihalation layer. In film D of this invention, YD-2 and C2 are replaced by 0.054 g/sq m of methine dye D21 of this invention along with 0.215 g/sq m of the high-boiling solvent S-7 in the yellow filter layer. No yellow dye is utilized in the antihalation layer in film D.

The spectral sensitivity of these films was obtained by exposing samples to nearly monochromatic light of measured intensity at 10 nm intervals through a step wedge and then processing the exposed films using a standard KODAK FLEXICOLOR C-41 process. The blue, green and red densities of the processed films were measured as a function of exposure, which provides a measure of the spectral sensitivity of each record. Table V gives logarithmic values for spectral sensitivity in units of log(1/ergs/sq cm) at 0.2 above Dmin for the blue records of films C-F at 450 nm and nm and for the green records of films C-F at 450 nm, 480 nm and 510 nm. What is desired is a large degree of separation between the sensitivity of the blue and green records at 450 nm and 480 nm (the green sensitivity being lower) while maintaining high sensitivity of the green records at 510 nm.

TABLE IV

| MULTILAYER FILM STRUCTURE | |
|---|---|
| 1 Overcoat Layer: | Matte Beads<br>Gelatin (0.89) |
| 2 UV Protective Layer: | UV-1 (0.081) & S-4 (0.081)<br>UV-2 (0.081) & S-4 (0.081)<br>Silver Bromide Lippmann Emulsion (0.269 Ag)<br>Gelatin (0.70) |
| 3 Fast Yellow Layer: | Y-2 (0.194) & S-2 (0.194)<br>Y-3 (0.151) & S-2 (0.076)<br>IR-5 (0.075)<br>& S-2 (0.075)<br>B-2 (0.0054) & S-3 (0.0054)<br>Blue Sensitive Silver Iodobromide Emulsion (0.523 Ag),<br>14 mole % Iodide Cubic (1.4 μm)<br>Blue Sensitive Silver Iodobromide Emulsion (0.430 Ag)<br>4.5 mole % Iodide T-Grain (2.9 × 0.13 μm)<br>Gelatin (1.83) |
| 4 Slow Yellow Layer: | Y-2 (0.807) & S-2 (0.807)<br>Y-3 (0.108) & S-2 (0.054)<br>IR-5 (0.108) & S-2 (0.108)<br>Blue Sensitive Silver Iodobromide Emulsion (0.178 Ag),<br>4.5 mole % Iodide Tabular-Grain (1.3 × 0.13 μm)<br>Blue Sensitive Silver Iodobromide Emulsion (0.118 Ag),<br>3.0 mole % Iodide Tabular-Grain (0.74 × 0.25 μm)<br>Blue Sensitive Silver Iodobromide Emulsion (0.178 Ag)<br>1.3 mole % Iodide Tabular-Grain (0.54 × 0.08 μm)<br>Gelatin (2.47)<br>Bis(vinylsulfonyl)methane Hardener at 1.7% by weight of total Gelatin (0.319) |
| 5 Yellow Filter Layer: | R-1 (0.086) & S-2 (0.139) & ST-2 (0.011)<br>Gelatin (0.538)<br>&<br>C YD-2 Filter Dye (0.065) (Comparison)<br>or D D21 (0.054) (Invention) & S-7 (0.215)<br>or E YD-1 Permanent Dye (0.129) (Comparison)<br>or F D21 (0.027) (Invention) & S-7 (0.108) |
| 6 Fast Magenta Layer: | M-1(0.086) & S-1 (0.077)<br>& ST-1 (0.009)<br>Green Sensitive Silver Iodobromide Emulsion (0.968 Ag),<br>3.5 mole % Iodide T-Grain (4.4 × 0.13 μm)<br>Gelatin (1.43) |
| 7 Mid Magenta Layer: | M-1 (0.097) & S-1 (0.087) & ST-1 (0.010)<br>MM-1 (0.108) & S-1 (0.216)<br>IR-6 (0.022) & S-1 (0.044)<br>Green Sensitive Silver Iodobromide Emulsion (1.184 Ag),<br>4.5 mole % Iodide Tabular-Grain (2.1 × 0.13 μm)<br>Gelatin (1.64) |
| 8 Slow Magenta Layer: | M-1 (0.269) & S-1 (0.242) & ST-1 (0.027)<br>Green Sensitive Silver Iodobromide Emulsion (0.226 Ag),<br>4.5 mole % Iodide Tabular-Grain (1.16 × 0.11 μm)<br>Green Sensitive Silver Iodobromide Emulsion (0.291 Ag),<br>4.5 mole % Iodide Tabular-Grain (1.5 × 0.09 μm)<br>Green Sensitive Silver Iodobromide Emulsion (0.355 Ag),<br>1.5 mole % Iodide T-Grain (0.69 × 0.12 μm)<br>Gelatin (1.72) |
| 9 Interlayer: | R-1 (0.086) & S-2 (0.139) & ST-2 (0.011)<br>Gelatin (0.54) |
| 10 Fast Cyan Layer: | CC-2 (0.172) & S-2 (0.172)<br>CM-1 (0.022)<br>IR-7 (0.032) & S-1 (0.128)<br>Red Sensitive Silver Iodobromide Emulsion (0.968 Ag),<br>3.5 mole % Iodide Tabular-Grain (4.2 × 0.14 μm)<br>Gelatin (1.61) |
| 11 Mid Cyan Layer: | CC-2 (0.204) & S-2 (0.204)<br>CM-1 (0.022)<br>IR-8 (0.043) & S-5 (0.086)<br>Red Sensitive Silver Iodobromide Emulsion (0.968 Ag),<br>3.5 mole % Iodide Tabular-Grain (2.4 × 0.12 μm)<br>Gelatin (1.52) |
| 12 Slow Cyan Layer: | CC-1 (0.624) & S-2 (0.624),<br>IR-8 (0.022) & S-5 (0.044)<br>B-2 (0.075) & S-3 (0.075)<br>Red Sensitive Silver Iodobromide Emulsion (0.301 Ag),<br>4.5 mole % Iodide Tabular-Grain (1.25 × 0.12 μm)<br>Red Sensitive Silver Iodobromide Emulsion (0.624 Ag),<br>4.5 mole % Iodide Tabular-Grain (1.00 × 0.09 μm)<br>Red Sensitive Silver Iodobromide Emulsion (0.463 Ag)<br>1.5 mole % Iodide Tabular-Grain (0.61 × 0.11 μm)<br>Gelatin (1.84) |
| 13 Antihalation Layer: | Grey Silver (0.15 Ag), CD-3 (0.011),<br>MD-1 (0.027)<br>UV-1 (0.059), UV-2 (0.059), R-1 (0.108),<br>C1 (0.011)<br>S-1, S-2, S-4, Gelatin (2.15)<br>&<br>C C2 (0.172)<br>or D No additional yellow dye<br>or E C2 (0.043)<br>or F C2 (0.043) |
| Cellulose Triacetate Support | |

S-7
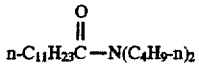
Y-2
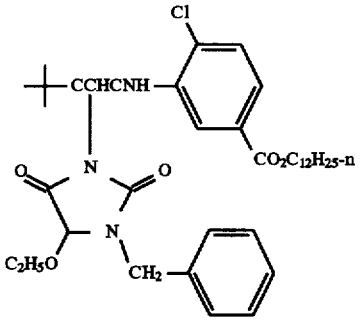
Y-3
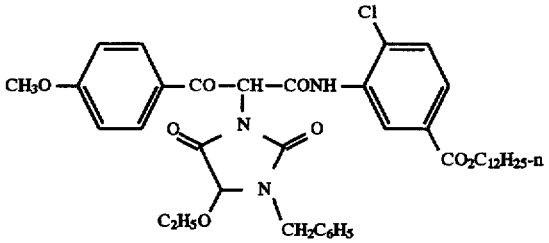
YD-1
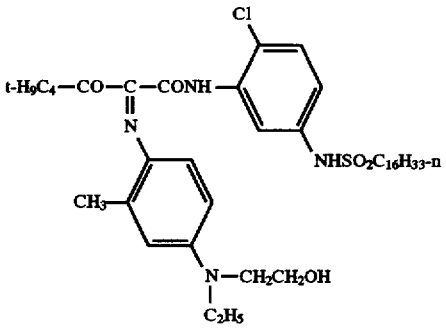
IR-5
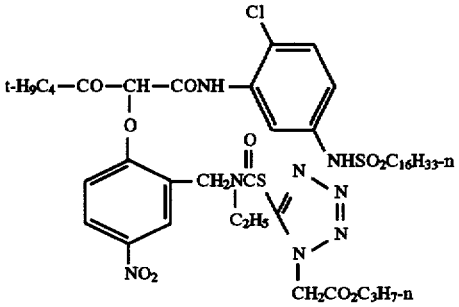
IR-6
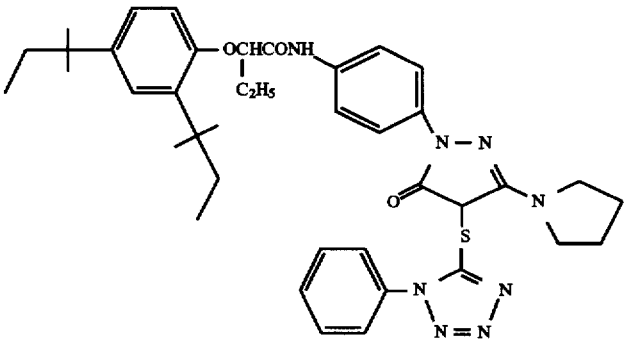

-continued
IR-7
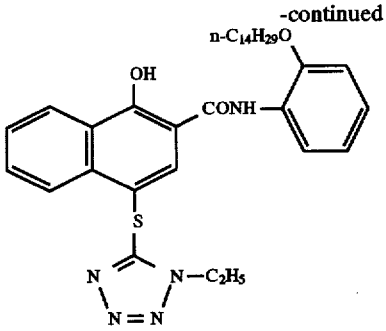
IR-8
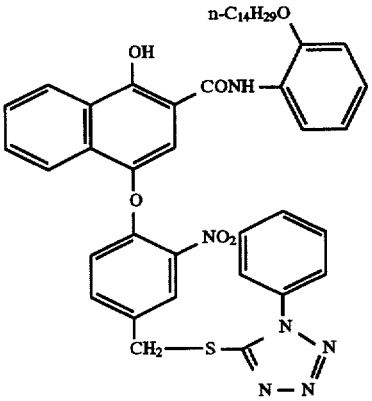
B-2
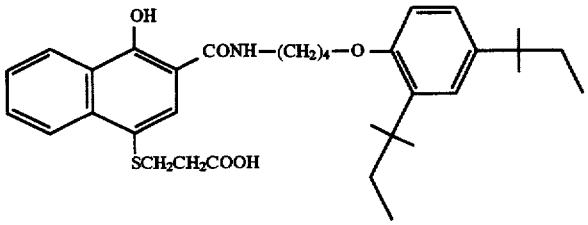
CC-2
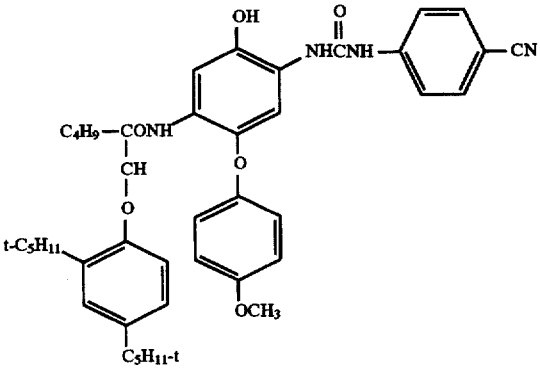
CD-3
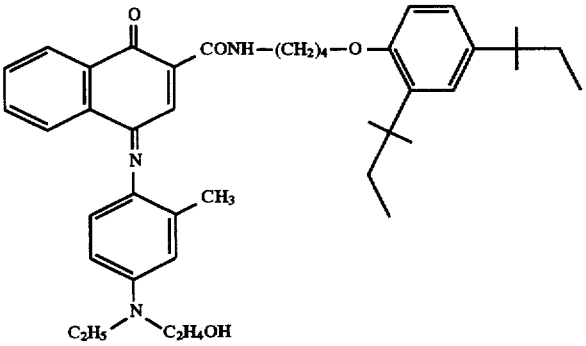

-continued

TABLE V

| Spectral Sensitivities {Exposures Required for Densities of 0.2 Above Dmin in Units of Log(1/ergs/sq cm)}of the Blue (B) and Green (G) Records of Films C and D. Log (1/ergs/sq cm) | | | | | |
|---|---|---|---|---|---|
| Film | B @ 450 nm | G @ 450 nm | B @ 480 nm | G @ 480 nm | G @ 510 nm |
| C | 2.75 | 1.21 | 2.64 | 1.58 | 2.51 |
| D | 2.76 | 0.79 | 2.64 | 1.08 | 2.43 |
| E | — | — | 2.66 | 1.53 | 2.41 |
| F | — | — | 2.67 | 1.45 | 2.52 |

From the data in Table V it is evident that film D of this invention is much more effective in increasing the separation between blue and green sensitivity at both 450 nm and 480 nm with no reduction in blue sensitivity and with minimal reduction in green sensitivity at 510 nm. Specifically, the unwanted sensitivity of the green records of film D is reduced by 0.42 log exposure units at 450 nm and by 0.50 log exposure units at 480 nm relative to film C, while the desirable green sensitivity at 510 nm is only reduced by 0.08 log exposure units for film D. This means that there is much less unwanted exposure of the magenta dye-forming green records of film D by blue light but little reduction in the speed of the green records toward green light for film D of this invention. The comparative data for film E vs film F of this invention shows that the much lower coated level of dye D21 of this invention is more efficient in improving blue vs green speed separation at 480 nm than the higher level of comparison dye YD-1, while D21 yields improved green sensitivity at 510 nm.

EXAMPLE 4

Use of the Yellow Methine Dyes of This Invention in a Color Negative Motion Picture Film of This Invention The yellow methine dyes of this invention may also be advantageously used in color negative motion picture films. Films H and I in Table VI below are representative of motion picture films of this invention comprising yellow methine dyes (D2, D35) of this invention. Chemical structures not given previously are shown below. These films require less bleachable filter dye (YD-2) than comparison film G and none of the yellow dye C2 that is used in G. C2 has less favorable absorption properties that lead to less efficient filtration of blue light and greater undesired green light attenuation. After exposure a standard KODAK EASTMAN COLOR NEGATIVE (ECN) process (in accordance with Research Disclosure, September 1994, Item 36544 and Eastman Kodak Co. Publication H-24 "Manual for Processing Eastman Color Film") was used for films G-I.

TABLE VI

| MULTILAYER FILM STRUCTURE | |
|---|---|
| 1 Overcoat Layer: | Matte Beads<br>Gelatin (0.87) |

TABLE VI-continued

| MULTILAYER FILM STRUCTURE | |
|---|---|
| 2 UV Protective Layer: | UV-1 (0.022) UV-2 (0.022)<br>S-1 (0.031) ST-2 (0.0044)<br>Silver Bromide Lippmann Emulsion (0.215 Ag)<br>Gelatin (0.70) |
| 3 Fast Yellow Layer: | Y-4 (0.333)<br>S-1 (0.183)<br>Blue Sensitive Silver Iodobromide Cubic Emulsion (1.70 Ag)<br>Gelatin (1.64) |
| 4 Slow Yellow Layer: | Y-4 (0.280)<br>Y-5 (0.484) & S-2 (0.161)<br>IR-9 (0.027) & S-2 (0.027)<br>Blue Sensitive Silver Iodobromide Tabular-Grain Emulsion (0.592 Ag)<br>Blue Sensitive Silver Iodobromide Tabular-Grain Emulsion (0.258 Ag)<br>Gelatin (1.64)<br>Bis(vinylsulfonyl)methane Hardener at 2.0% by weight of total Gelatin (0.272) |
| 5 Yellow Filter Layer: | R-2 (0.108)<br>Gelatin (0.646)<br>&<br>G C2 (0.043) & YD-2 Filter Dye (0.151) (Comparison)<br>or H D2 (0.032) & S-6 (0.064) & YD-2 (0.118) (Invention)<br>or I D35 (0.032) & S-1 (0.064) & YD-2 (0.188) (Invention) |
| 6 Fast Magenta Layer: | M-1 (0.081) & S-1 (0.065)<br>& ST-1 (0.016) MM-1 (0.022) & S-1 (0.044)<br>M-2 (0.0151) & M-3 (0.0065) & S-1 (0.0108)<br>Green Sensitive Silver Iodobromide Tabular-Grain Emulsion (1.12 Ag)<br>Gelatin (1.29) |
| Slow Magenta Layer: | M-2 (0.255) & M-3 (0.109) & S-1 (0.182)<br>MM-1 (0.133) & S-1 (0.266)<br>IR-6 (0.033) & S-1 (0.066)<br>CC-1 (0.080) & S-2 (0.080)<br>Green Sensitive Silver Iodobromide Tabular-Grain Emulsion (1.37 Ag)<br>Green Sensitive Silver Iodobromide Tabular-Grain Emulsion (1.11 Ag)<br>Gelatin (2.29) |
| 8 Interlayer: | R-2 (0.108)<br>&<br>G C2 (0.043) (Comparison)<br>or H No yellow dye (Invention)<br>or I No yellow dye (Invention)<br>Gelatin (0.65) |
| 9 Fast Cyan Layer: | CC-1 (0.080) & S-2 (0.080)<br>CM-1 (0.027)<br>Red Sensitive Silver Iodobromide Tabular-Grain Emulsion (1.10 Ag)<br>Gelatin (1.17) |
| 10 Slow Cyan Layer: | CC-1 (0.323) & S-2 (0.323)<br>CM-1 (0.027)<br>B-2 (0.065) & S-3 (0.065)<br>IR-10 (0.019) & S-5 (0.036)<br>IR-11 (0.022) & S-5 (0.044)<br>Red Sensitive Silver Iodobromide Tabular-Grain Emulsion (1.90 Ag)<br>Red Sensitive Silver Iodobromide Tabular-Grain Emulsion (0.36 Ag)<br>Gelatin (2.54) |
| Cellulose Triacetate Support | |

Y-4
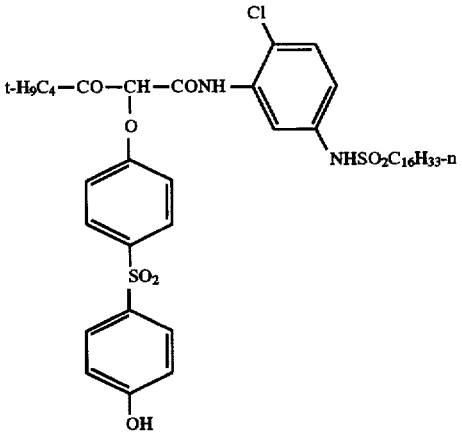
Y-5
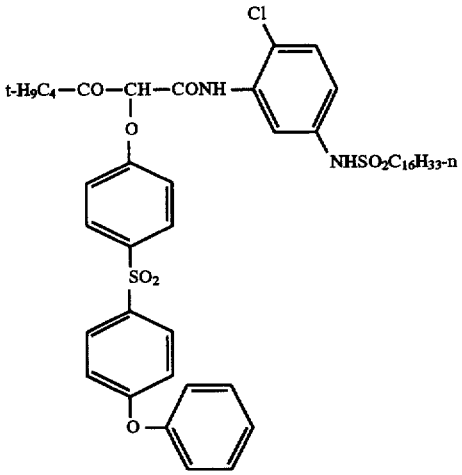
IR-9
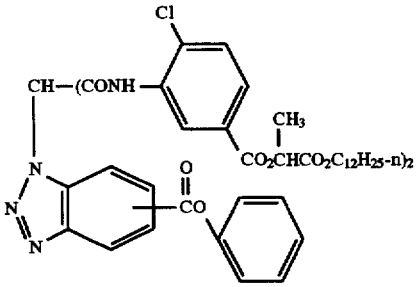
R-2
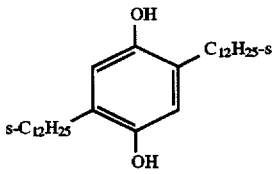
M-2
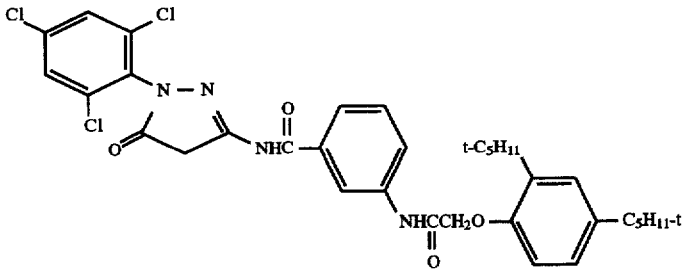

-continued

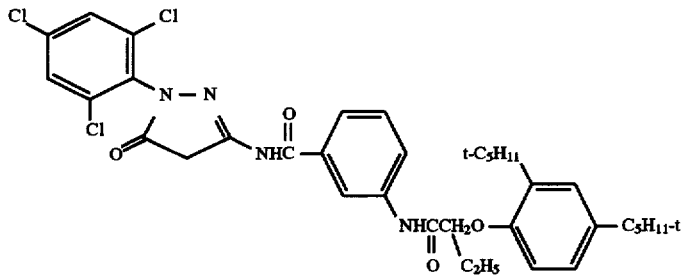

M-3

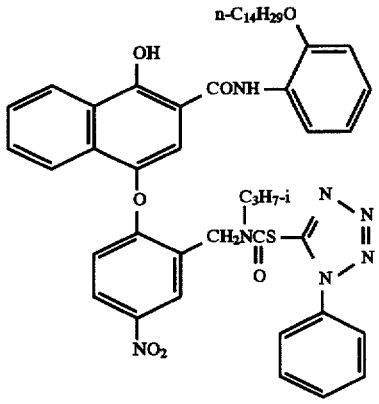

IR-10

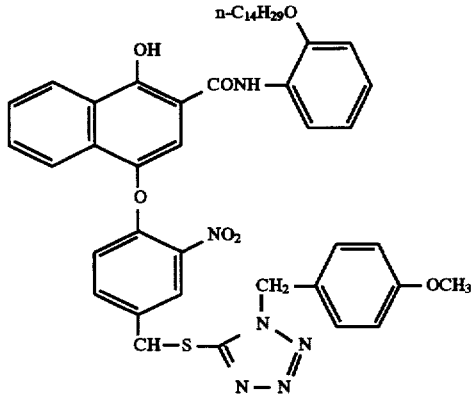

IR-11

The preceding examples are set forth to illustrate specific embodiments of this invention and are not intended to limit the scope of the compositions or materials of the invention. Additional embodiments and advantages within the scope of the claimed invention will be apparent to one skilled in the art.

What is claimed is:

1. A multilayer color negative photographic film comprising a support, at least one light-sensitive silver halide emulsion layer sensitive to each of the blue, green and red regions of the visible spectrum and a yellow or orange-yellow methine dye of structure I,

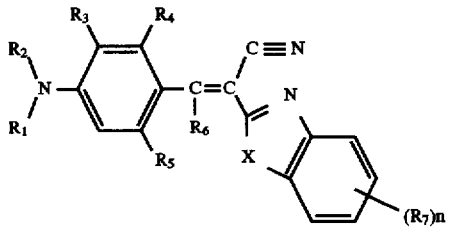

I wherein:

$R_1$ is hydrogen or an alkyl group;

$R_2$ is an alkyl group or an aryl group;

$R_3$ is hydrogen, a halogen atom, an alkyl group, an alkoxy group or an aryloxy group;

$R_4$ is hydrogen or an alkyl group;

$R_5$ is hydrogen or an alkyl group;

$R_6$ is hydrogen or an alkyl group;

X is oxygen or sulfur;

each $R_7$ is independently a substituent selected from the group consisting halogen atoms, and alkyl, aryl, alkoxy, aryloxy, carbonamido, sulfonamido, carbamoyl, alkoxycarbonyl, aryloxycarbonyl, acyloxy, acyl, sulfamoyl, sulfonyl, sulfoxyl, sulfonyloxy, alkylthio, arylthio, and cyano groups;

n is 0, 1, 2 or 3; and $R_1$ and $R_2$ or $R_2$ and $R_3$ may join to form a ring.

2. A color negative film according to claim 1, wherein the methine dye has a spectral absorption maximum in the range of 435–475 nm as coated in the film.

3. A color negative film according to claim 2, wherein the methine dye has a spectral absorption maximum in the range of 440–470 nm as coated in the film.

4. A color negative film according to claim 1, wherein the methine dye is coated at a level of from 0.005 to 0.150g/sq m.

5. A color negative film according to claim 4, wherein the methine dye is coated at a level of from 0.010 to 0.10g/sq m.

6. A color negative film according to claim 1, wherein the total number of carbon atoms in $R_1$ through $R_7$ is at least 8.

7. A color negative film according to claim 6, wherein the total number of carbon atoms in $R_1$ through $R_7$ is at least 10.

8. A color negative film according to claim 1, wherein the methine dye does not contain charged groups, carboxyl groups or sulfonate groups.

9. A color negative film according to claim 1, wherein the methine dye is dispersed together with a high-boiling solvent at a dye:solvent weight ratio of from 0.1 to 10.0.

10. A color negative film according to claim 1, wherein the methine dye is coated as a dispersion prepared without the use of a removable auxiliary solvent.

11. A color negative film according to claim 1 wherein $R_4$ is hydrogen.

12. A color negative film according to claim 1 wherein X is oxygen.

13. A color negative film according to claim 1 wherein $R_5$ is an alkyl group.

14. A color negative film according to claim 1 wherein $R_6$ is hydrogen.

15. A color negative film according to claim 1 wherein $R_2$ is an alkyl group.

16. A color negative film according to claim 1 wherein $R_1$ is hydrogen, $R_2$ is alkyl, $R_3$ is hydrogen or alkyl, $R_4$ is hydrogen, $R_5$ is alkyl, $R_6$ is hydrogen, X is oxygen, n is 0 or 1 and, when n is 1, $R_7$ is an alkyl group, a sulfonamido group or a halogen in the para position relative to X.

17. A color negative film according to claim 1, wherein $R_1$ and $R_2$ are alkyl groups, $R_3$, $R_4$ and $R_6$ are hydrogen, $R_5$ is an alkyl group, X is oxygen, n is 0 or 1 and, when n is 1, $R_7$ an alkyl group, a sulfonamido group or a halogen in the para position relative to X.

18. A color negative film according to claim 1, wherein the methine dye is selected from the group consisting of the following:

D1

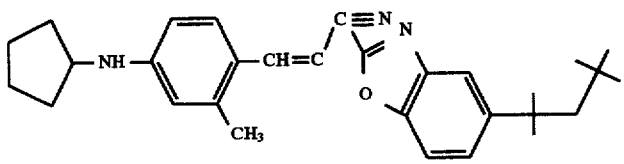

D2

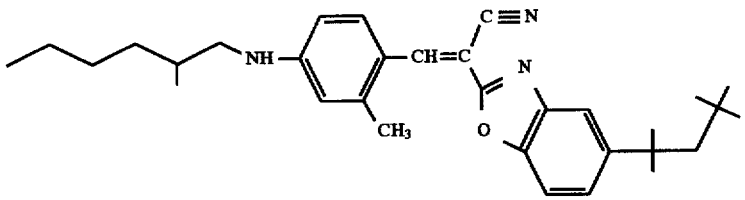

D3

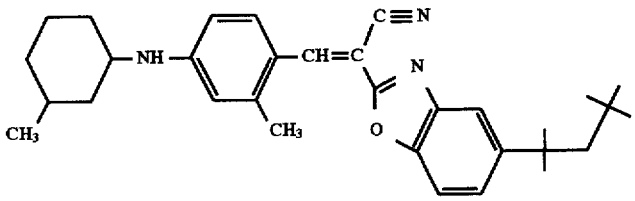

D6

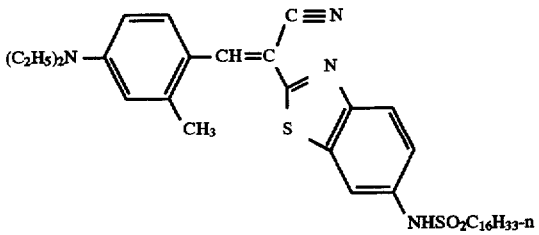

D8

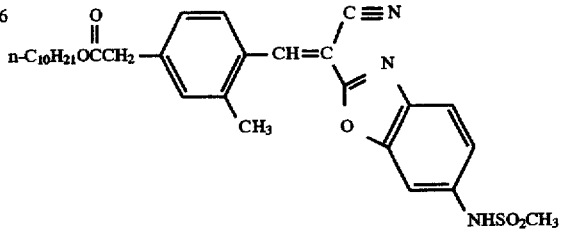

-continued

D9

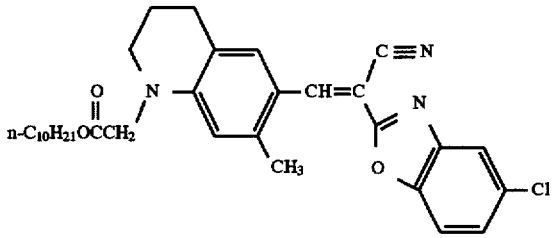

D21

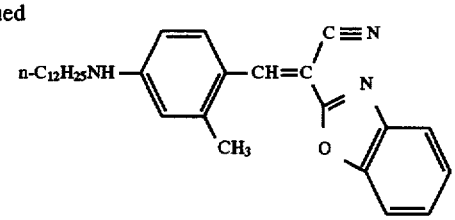

D22

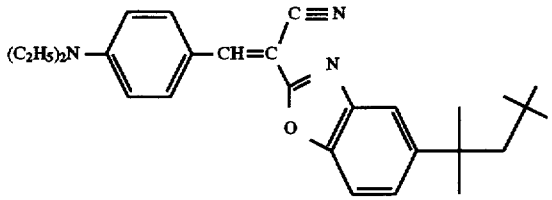

D23

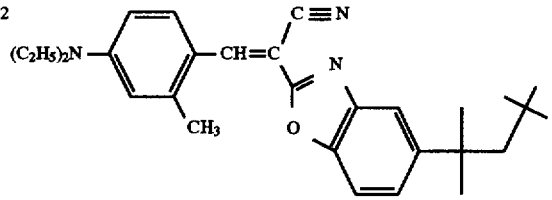

D25

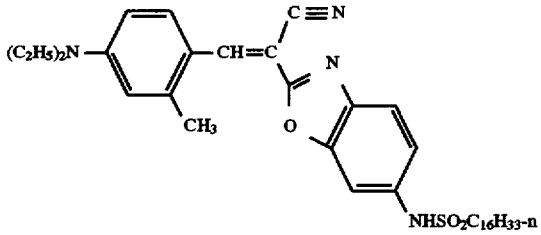

D26

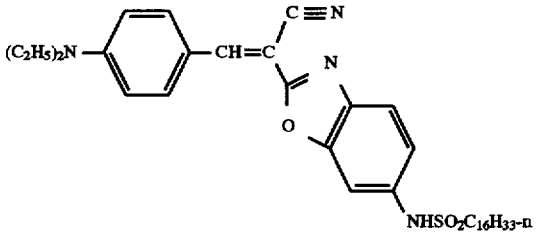

D29

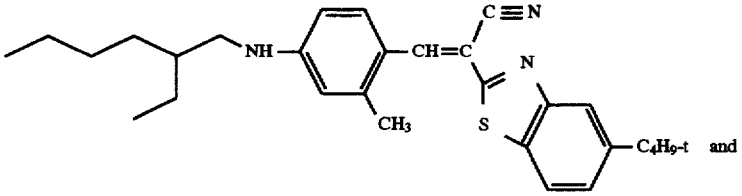

and

D35

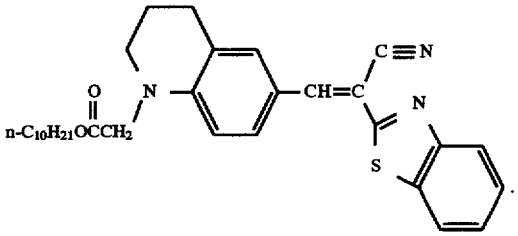

19. A color negative film according to claim 1, wherein the methine dye is coated in an antihalation layer.

20. A color negative film according to claim 1, wherein the methine dye is coated in a filtration layer between blue and green-sensitive layers.

21. A color negative film according to claim 1 which is sold with instructions to process in accordance with processes used for color negative motion picture film.

22. A color negative film according to claim 1, wherein the methine dye is coated in the same layer with a reducing agent.

* * * * *